US005725275A

United States Patent [19]

Wigfall

[11] Patent Number: 5,725,275

[45] Date of Patent: Mar. 10, 1998

[54] CHAIR FOR DISABLED

[76] Inventor: Lenora Wigfall, 1371 Manor Dr., San Pablo, Calif. 94806

[21] Appl. No.: 783,356

[22] Filed: Jan. 16, 1997

[51] Int. Cl.[6] ..... A47C 3/025

[52] U.S. Cl. ..... 297/284.1; 297/452.22; 297/DIG. 4; 297/183.1

[58] Field of Search ..... 297/DIG. 4, 452.22, 297/182, 183.6, 183.7, 440.1, 284.1, 118, 183.1, 188.01, 188.08, 188.09, 188.11, 188.12, 188.13, 337, 452.21, 440.22, 250.1; 280/250.1; 4/239

[56] References Cited

U.S. PATENT DOCUMENTS

| | | | |
|---|---|---|---|
| 1,952,216 | 3/1934 | Owings | 297/188.11 X |
| 2,037,578 | 4/1936 | Hoaglund et al. | 297/182 X |
| 4,067,409 | 1/1978 | DiMatteo et al. | 297/DIG. 4 X |
| 4,266,305 | 5/1981 | Kavaloski et al. | 297/DIG. 4 X |
| 4,287,619 | 9/1981 | Brewer et al. | 297/DIG. 4 X |
| 5,586,806 | 12/1996 | Hergott | 297/188.11 |

*Primary Examiner*—Milton Nelson, Jr.

[57] ABSTRACT

A new Chair for Disabled for allowing a user to use a toilet without having to be moved from the Chair for Disabled. The inventive device includes a seat with four downwardly depending vertical legs having a caster on the end of each leg. The seat has a centrally positioned opening for toilet use. A retractable central seat panel is slidably mounted to the bottom of the seat. A handle or a cable winch attached to the retractable central seat panel allows the retractable central seat panel to be positioned beneath the centrally positioned opening.

13 Claims, 4 Drawing Sheets

CHAIR FOR DISABLED

BACKGROUND OF THE INVENTION

1. Field of the Invention

The present invention relates to chairs employed specifically for invalid persons and more particularly pertains to a new Chair for Disabled for allowing a user to use a toilet without having to be moved from the Chair for Disabled.

2. Description of the Prior Art

The use of chairs employed specifically for invalid persons is known in the prior art. More specifically, chairs employed specifically for invalid persons heretofore devised and utilized are known to consist basically of familiar, expected and obvious structural configurations, notwithstanding the myriad of designs encompassed by the crowded prior art which have been developed for the fulfillment of countless objectives and requirements.

Known prior art chairs employed specifically for invalid persons include U.S. Pat. No. 4,654,904; U.S. Pat. No. 4,514,867; U.S. Pat. Des. 257,879; U.S. Pat. No. 4,428,615; U.S. Pat. No. 4,287,619 and U.S. Pat. No. 4,067,409.

While these devices fulfill their respective, particular objectives and requirements, the aforementioned patents do not disclose a new Chair for Disabled. The inventive device includes a seat with four downwardly depending vertical legs having a caster on the end of each leg. The seat has a centrally positioned opening for toilet use. A retractable central seat panel is slidably mounted to the bottom of the seat. A handle or a cable winch attached to the retractable central seat panel allows the retractable central seat panel to be positioned beneath the centrally positioned opening.

In these respects, the Chair for Disabled according to the present invention substantially departs from the conventional concepts and designs of the prior art, and in so doing provides an apparatus primarily developed for the purpose of allowing a user to use a toilet without having to be moved from the Chair for Disabled.

SUMMARY OF THE INVENTION

In view of the foregoing disadvantages inherent in the known types of chairs employed specifically for invalid persons now present in the prior art, the present invention provides a new Chair for Disabled construction wherein the same can be utilized for allowing a user to use a toilet without having to be moved from the Chair for Disabled.

The general purpose of the present invention, which will be described subsequently in greater detail, is to provide a new Chair for Disabled apparatus and method which has many of the advantages of the chairs employed specifically for invalid persons mentioned heretofore and many novel features that result in a new Chair for Disabled which is not anticipated, rendered obvious, suggested, or even implied by any of the prior art chairs employed specifically for invalid persons, either alone or in any combination thereof.

To attain this, the present invention generally comprises a seat with four downwardly depending vertical legs having a caster on the end of each leg. The seat has a centrally positioned opening for toilet use. A retractable central seat panel is slidably mounted to the bottom of the seat. A handle or a cable winch attached to the retractable central seat panel allows the retractable central seat panel to be positioned beneath the centrally positioned opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Chair for Disabled apparatus and method which has many of the advantages of the chairs employed specifically for invalid persons mentioned heretofore and many novel features that result in a new Chair for Disabled which is not anticipated, rendered obvious, suggested, or even implied by any of the prior art chairs employed specifically for invalid persons, either alone or in any combination thereof.

It is another object of the present invention to provide a new Chair for Disabled which may be easily and efficiently manufactured and marketed.

It is a further object of the present invention to provide a new Chair for Disabled which is of a durable and reliable construction.

An even further object of the present invention is to provide a new Chair for Disabled which is susceptible of a low cost of manufacture with regard to both materials and labor, and which accordingly is then susceptible of low prices of sale to the consuming public, thereby making such Chair for Disabled economically available to the buying public.

Still yet another object of the present invention is to provide a new Chair for Disabled which provides in the apparatuses and methods of the prior art some of the advantages thereof, while simultaneously overcoming some of the disadvantages normally associated therewith.

Still another object of the present invention is to provide a new Chair for Disabled for allowing a user to use a toilet without having to be moved from the Chair for Disabled.

Yet another object of the present invention is to provide a new Chair for Disabled which includes a seat with four downwardly depending vertical legs having a caster on the end of each leg. The seat has a centrally positioned opening for toilet use. A retractable central seat panel is slidably mounted to the bottom of the seat. A handle or a cable winch attached to the retractable central seat panel allows the retractable central seat panel to be positioned beneath the centrally positioned opening.

Still yet another object of the present invention is to provide a new Chair for Disabled that may be easily maneuvered into or through tight or narrow areas.

Even still another object of the present invention is to provide a new Chair for Disabled that reduces a user's need for assistance from others when using a toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
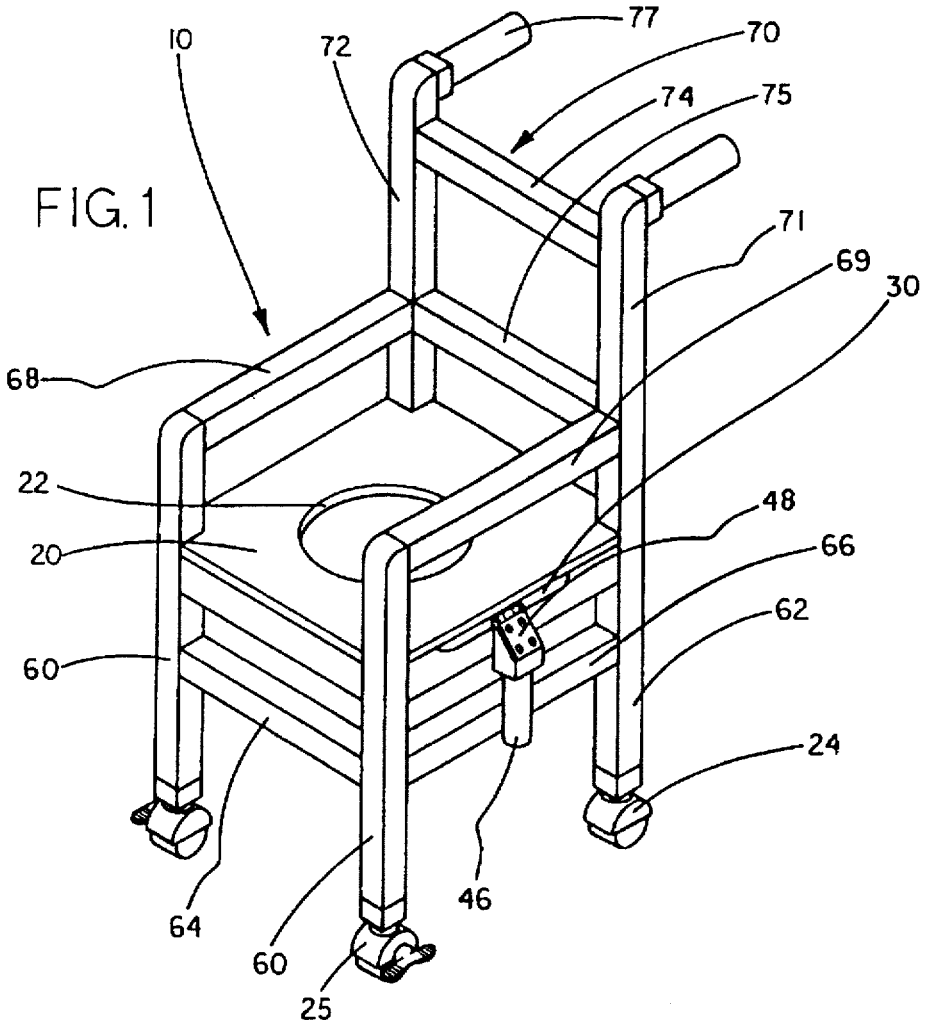
FIG. 1 is a perspective view of a new Chair of Disabled according to the present invention.

With reference now to the drawings, and in particular to FIGS. 1 through 6 thereof, a new Chair for Disabled embodying the principles and concepts of the present invention and generally designated by the reference numeral 10 will be described.

More specifically, it will be noted that the Chair for Disabled 10 comprises a seat 20 with a centrally positioned opening 22, a pair of front vertical legs 60, a pair of rear vertical legs 62, each vertical leg having a caster 24, a retractable central seat panel 30, and a retracting means of a handle 46 or a cable winch system 50.

As best illustrated in FIGS. 1 through 6, it can be shown that the Chair for Disabled 10 is based around a conventional chair having a seat 20 with a pair of front vertical legs 60 and a pair of rear vertical legs 62 downwardly depending from and attached to the seat 20. A front brace 64 is attached to the two front vertical legs 60 providing extra stability to the Chair for Disabled 10. Likewise, a side brace 66 is attached to each front vertical leg 60 and its same side rear vertical leg 62. A caster 24 is attached to the bottom end of each vertical leg. Generally the casters 24 should be swivel type casters to allow easy maneuvering of the Chair for Disabled 10. Optionally, some or all of the casters 24 may be locking casters 25 to prevent unwanted movement of the invention when in use. A foot stool may be attached to the front vertical legs 60 for added comfort.

The Chair for Disabled 10 also includes a backrest 70 which as shown in FIG. 1 may comprise a left side back post 71 and a right side back post 72 spaced apart and extending upwardly from the seat 20. A lower back brace 75 and an upper brace 74 are attached to the left side back post 71 and the right side back post 72. The Chair for Disabled 10 also includes a left side arm rest 68 and a right side arm rest 69. The arm rests may be adapted to allow hospital trays or other devices to be mounted to them. A pair of push handles 77 are attached to the top portion of the left side back post 68 and right side back post 69 to allow an other person to assist the user in moving and positioning the Chair for Disabled 10.

The seat 20 has a centrally positioned opening 22 designed for allowing access to a toilet 78. The centrally positioned opening 22 may include a polyurethane or aluminum collar around its circumference. The retractable central seat panel 30 is slidably mounted to the bottom face of the seat 20 by a pair of seat panel support rails 42. The seat panel support rails 42 are attached to the seat 20 so that they are parallelly spaced apart from each other on either side of the centrally positioned opening 22. Each seat panel support rail 42 includes a plurality of support rail rollers 44 which allows the retractable central seat panel 30 to slide on the seat panel support rail.

Figure 2:
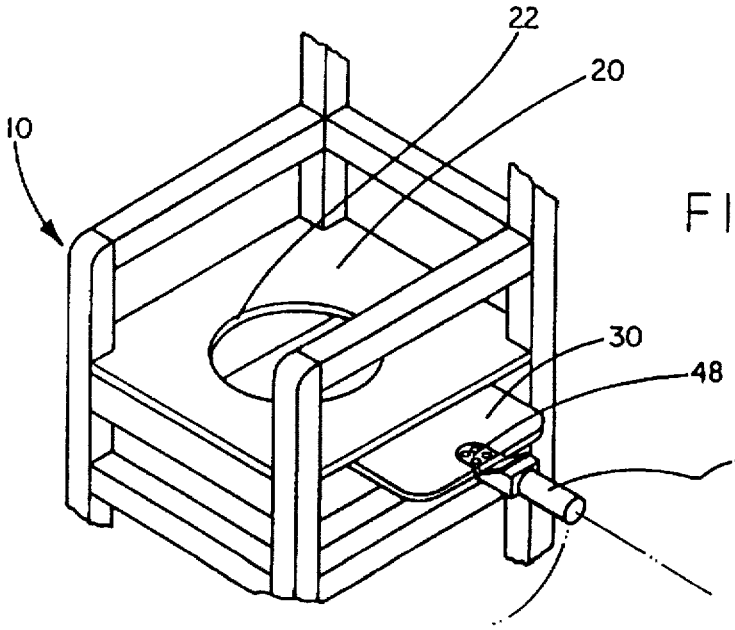
FIG. 2 is a partial perspective view of the seat showing the retractable central seat panel.
Figure 3:
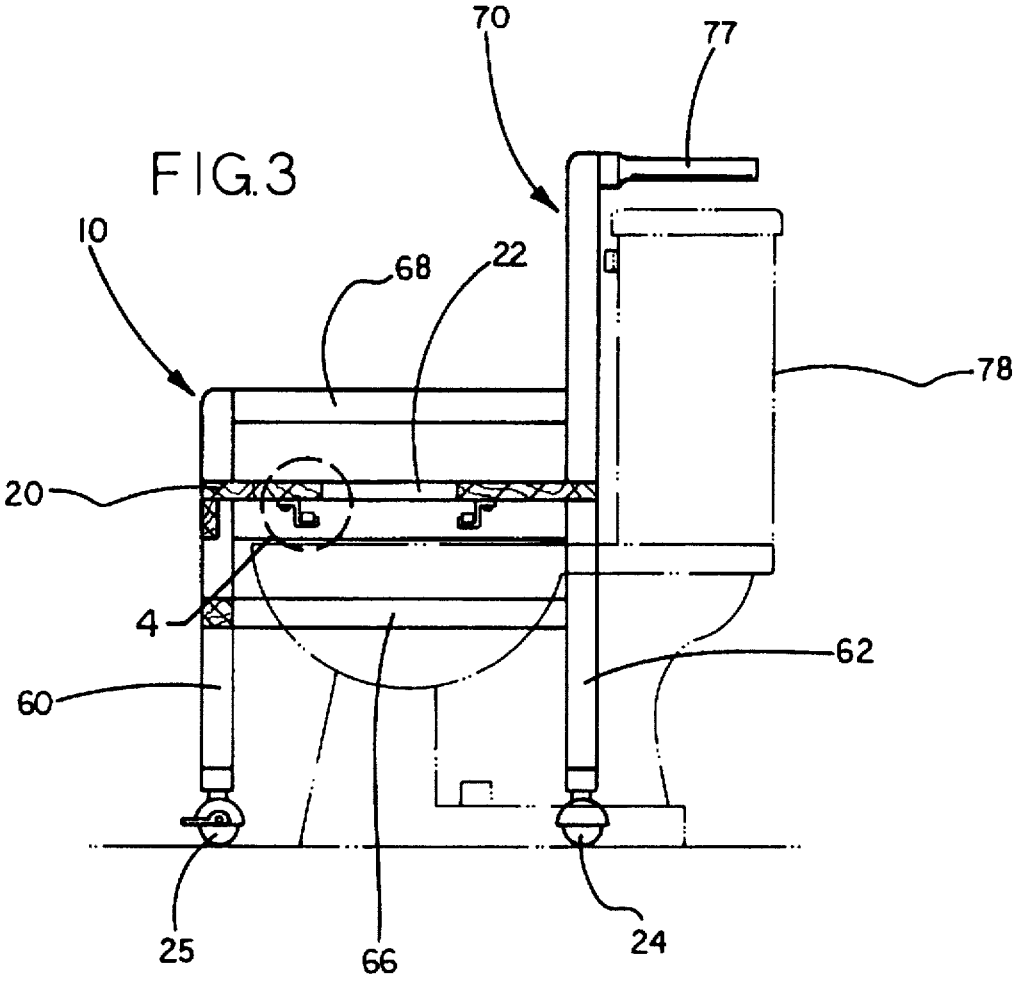
FIG. 3 is a side view of the present invention over a conventional toilet.
Figure 4:
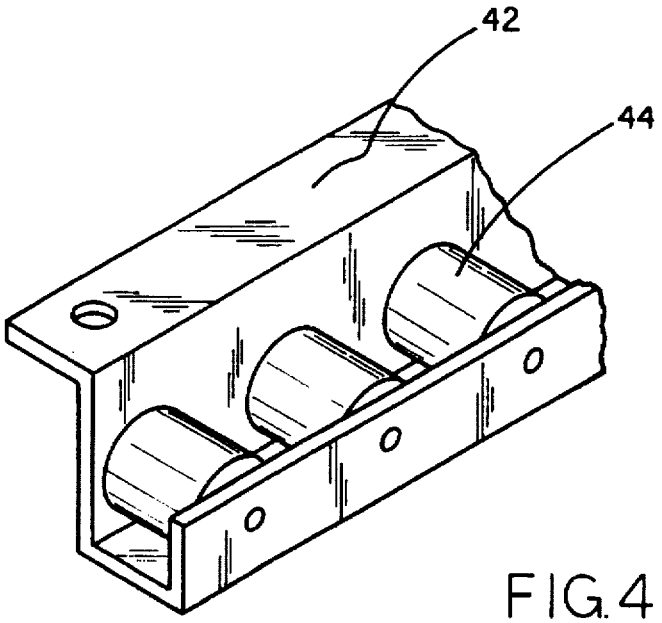
FIG. 4 is a partial perspective view of a seat panel support rail as indicated by the circle 4 in FIG. 3.

There are two retracting means options that allow the retractable central seat panel 30 to be positioned underneath the centrally positioned opening 22 to close the centrally positioned opening 22. The first option, as shown in FIGS. 1 and 2, is to a attach a handle to 47 the retractable central seat panel 30 so that the handle extends from the side of the seat and may be adjusted to position the retractable central seat panel 30. The handle 46 may be attached to the retractable central seat panel 30 by a hinge 48 so that the handle 46 may be folded when not in use to help allow the Chair for Disabled 10 to be positioned in narrow spaces.

Figure 5:
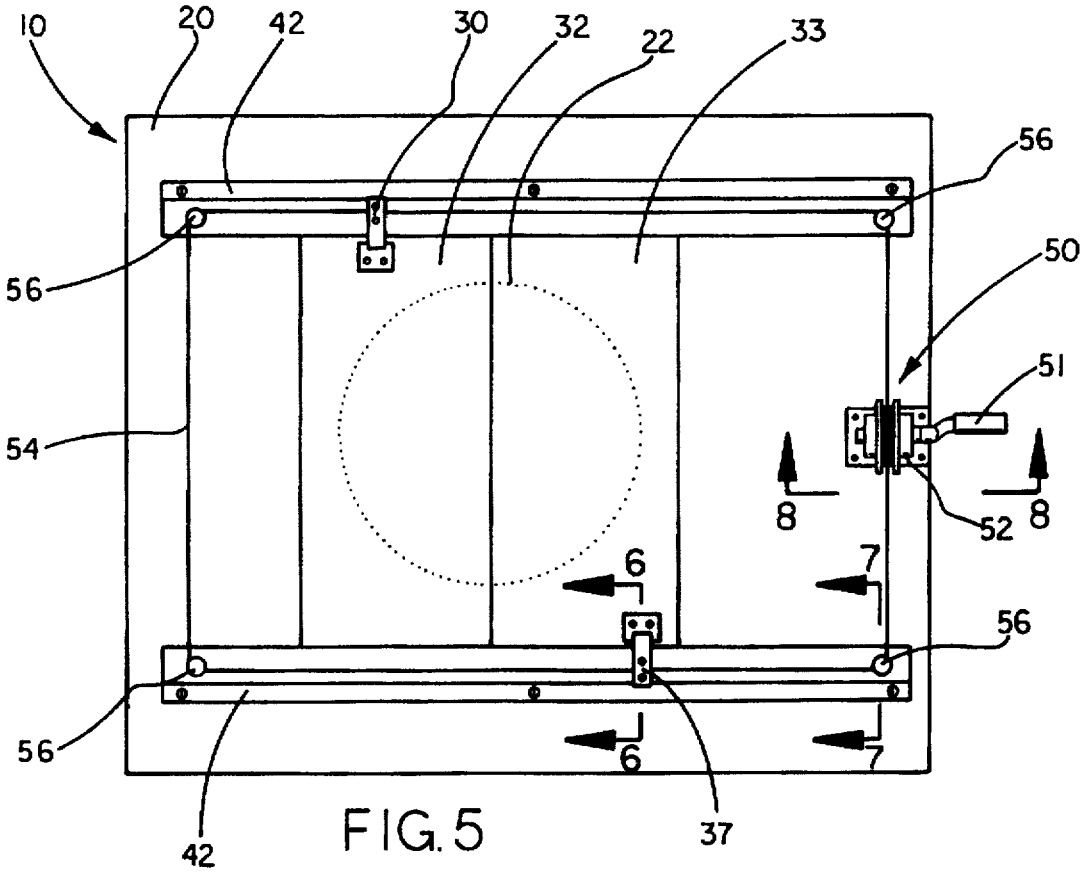
FIG. 5 is a bottom view showing the cable winch system attached to the first and second central seat panel portion.
Figure 6:
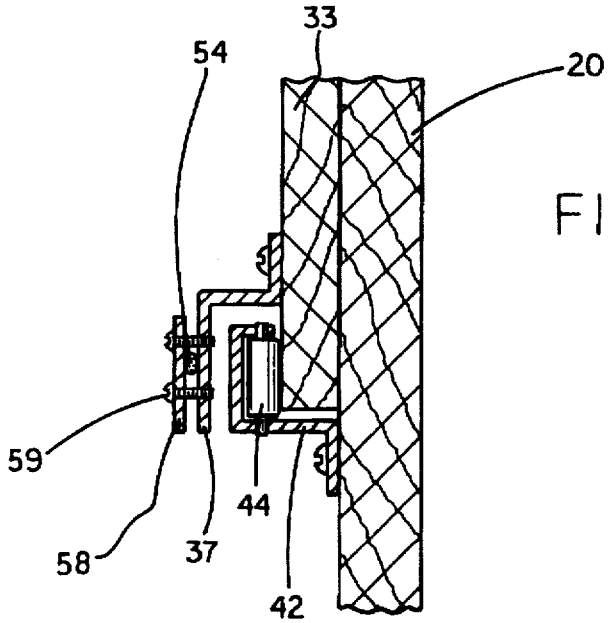
FIG. 6 is a cross sectional view taken along line 6—6 of FIG. 5.
Figure 7:
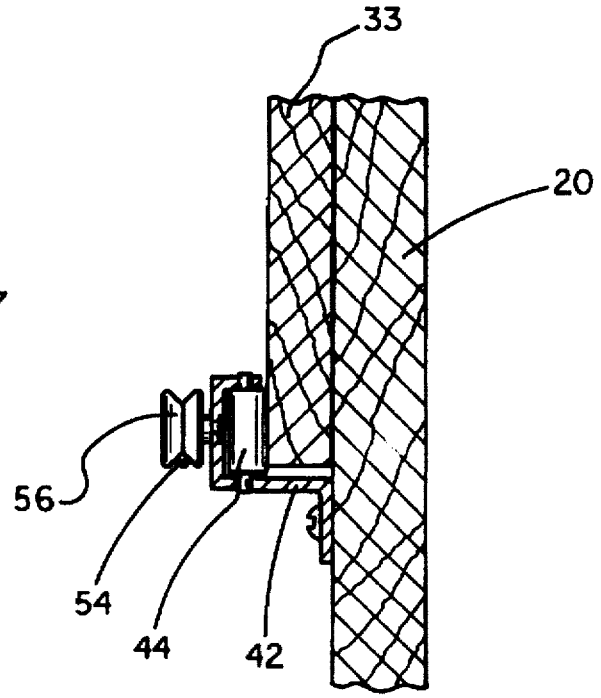
FIG. 7 is a cross sectional view taken along line 7—7 of FIG. 5.
Figure 8:
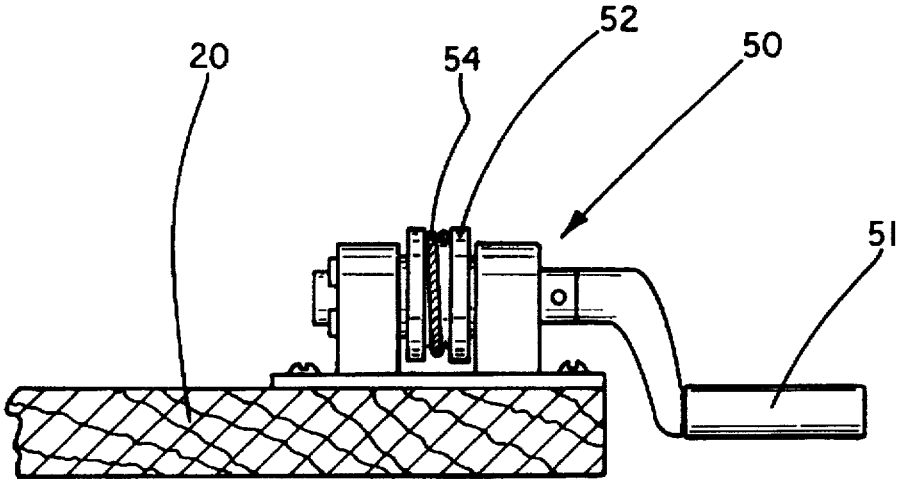
FIG. 8 is a sectional view taken along line 8—8 of FIG. 5 of the cable winch.

The second retracting means option uses a cable winch system 50 to position the retractable central seat panel 30 as shown in FIG. 5. In this option, the retractable central seat panel 30 comprises two separate pieces: a first central seat panel portion 32 and a second central seat panel portion 33. The first central seat panel portion 32 and the second central seat panel portion 33 are slidably mounted to the seat 20 on the seat panel support rails 42. A first panel retracting bracket 36 is attached to the first central seat panel portion 32 and a second panel retracting bracket 37 is attached to the second central seat panel portion 33.

The first central seat panel portion 32 and the second central seat panel portion 33 are attached to a retracting system controlled by a cable winch 52. A sheave 56 is mounted to each end of the seat panel support rails. A retracting cable 54 is passed around each sheave 56 and has both end attached and wound around the cable winch 52. The retracting cable is attached to the first panel retracting bracket 36 and the second panel retracting bracket 37 by a pair of cable clamps 58 which are held to the brackets by clamp tightening screws 59. This retracting system is designed so that retracting cable 54 is moved around the sheaves 56 when the cable winch 52 is rotated by the winding crank 51. The retracting cable 54 movement causes the first central seat panel portion 32 and the second central seat panel portion 33 to slide on the seat panel support rails. Thus, by operating the cable winch 52, the first central seat panel portion 32 and the second central seat panel portion 33 may be positioned underneath the centrally positioned opening 22 to close the centrally positioned opening 22.

When a person seated on Chair for Disabled 10 needs to use a toilet 78, the retractable central seat panel 30 or the first and second central seat panel portions 32, 33 must be retracted so that the centrally positioned opening 22 is exposed. This is done by using either the handle 46 or the cable winch system 50. Next, the Chair for Disabled 10 is moved over a toilet 78 so that the centrally positioned opening is over the toilet 78. When finished with the toilet 78, the centrally positioned opening 22 may be closed by positioning the retractable central seat panel 30 or the first and second central seat panel portions 32, 33 underneath the centrally positioned opening 22 by using the handle 46 or the cable winch system 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

What is claimed as being new and desired to be protected by LETTERS PATENT of the United States is as follows:

1. A Chair for Disabled, comprising:

a seat having a centrally positioned opening, an upper face, and a lower face, said lower face having a front portion and a rear portion;

a first front vertical leg having a caster;

a second front vertical leg having a caster, said first front vertical leg and said second front vertical leg being spaced apart and being coupled to said seat and downwardly depending from said front portion of said lower face;

a first rear vertical leg having a caster;

a second rear vertical leg having a caster, said first rear vertical leg and said second rear vertical leg being spaced apart and being coupled to said seat and downwardly depending from said rear portion of said lower face; and a retracting central seat panel having an upper surface and a retracting means, said retracting central seat panel being slidably mounted to said lower face of said seat, said upper surface of said retracting central seat panel being positioned adjacent said lower face of said seat, said retracting central seat panel being positionable beneath said centrally positioned opening by said retracting means whereby said centrally positioned opening may be closed by said retracting central seat panel in a manner where said upper face of said seat and the area of said upper surface of said retracting central seat panel form a substantially continuous sitting area for resting of a user thereon.

2. The Chair for Disabled of claim 1, wherein said retracting means comprises a handle being pivotally coupled to said retracting central seat panel.

3. The Chair for Disabled of claim 2, wherein said handle is pivotally coupled to said retracting central seat panel by means of a hinge.

4. The Chair for Disabled of claim 1, wherein said retracting central seat panel comprising a first central seat panel portion and a second central seat panel portion, said first central seat panel portion and said second central seat panel portion being slidably mounted to said lower face of said seat, and wherein said retracting means comprises a cable winch system being operatively connected to said first central seat panel portion and said second central seat panel portion, said first central seat panel portion and said second central seat portion being positionable beneath said centrally positioned opening by said cable winch system whereby said centrally positioned opening may be closed by said first central seat panel portion and said second central seat portion.

5. The Chair for Disabled of claim 1, further comprising a backrest being extended upward from said rear portion of said seat.

6. The Chair for Disabled of claim 5, further comprising a pair of push handles being coupled to said backrest.

7. The Chair for Disabled of claim 1, wherein at least two of said casters are locking casters.

8. A Chair for Disabled, comprising:

a seat having a centrally positioned opening, a front portion, a rear portion, and a lower face;

a first front vertical leg having a caster;

a second front vertical leg having a caster, said first front vertical leg and said second front vertical leg being spaced apart and being coupled to said front portion of said seat and downwardly depending from said lower face;

a first rear vertical leg having a caster;

a second rear vertical leg having a caster, said first rear vertical leg and said second rear vertical leg being spaced apart and being coupled to said rear portion of said seat and downwardly depending from said lower face;

a front brace being coupled to said first front vertical leg and said second front vertical leg;

a first side brace being coupled to said first front vertical leg and said first rear vertical leg;

a second side brace being coupled to said second front vertical leg and said second rear vertical leg;

a first central seat panel portion and a second central seat panel portion being slidably mounted to said lower face of said seat; and a cable being coupled to said first central seat panel and said second central seat panel;

a cable winch being operatively connected to said cable, said first central seat panel portion and said second central seat portion being positionable beneath said centrally positioned opening by operating said cable winch whereby said centrally positioned opening may be closed by said first central seat panel portion and said second central seat portion.

9. The Chair for Disabled of claim 8, further comprising a backrest being extended upward from said rear portion of said seat.

10. The Chair for Disabled of claim 9, further comprising a pair of push handles being coupled to said backrest.

11. The Chair for Disabled of claim 8, further comprising a first side arm rest and a second side arm rest, said first side arm rest and said second side arm rest being spaced apart and being coupled to said seat.

12. The Chair for Disabled of claim 8, wherein at least two of said casters are locking casters.

13. A chair for disabled, comprising:

a seat having a centrally positioned opening and a lower face, said lower face having a front portion and a rear portion;

a first front vertical leg having a caster;

a second front vertical leg having a caster, said first front vertical leg and said second front vertical leg being spaced apart and being coupled to said seat and downwardly depending from said front portion of said lower face;

a first rear vertical leg having a caster;

a second rear vertical leg having a caster, said first rear vertical leg and said second rear vertical leg being spaced apart and being coupled to said seat and downwardly depending from said rear portion of said lower face;

a retracting central seat panel having a retracting means and being slidably mounted to said lower face of said seat, said retracting central panel being positionable beneath said centrally positioned opening by said retracting means whereby said centrally positioned opening may be closed by said retracting central seat panel;

wherein said retracting central seat panel comprising a first central seat panel portion and a second central seat panel portion, said first central seat panel portion and said second central seat panel portion being slidably mounted to said lower face of said seat; and wherein said retracting means comprises a cable winch system being operatively connected to said first central seat panel portion and said second central seat panel portion, said first central seat panel portion and said second central seat portion being positionable beneath said centrally positioned opening by said cable winch system whereby said centrally positioned opening may be closed by said first central seat panel portion and said second central seat portion.

* * * * *